US009134035B2

(12) United States Patent
Tatlow

(10) Patent No.: US 9,134,035 B2
(45) Date of Patent: Sep. 15, 2015

(54) PORTABLE FUEL-FIRED COOKING APPLIANCE

(76) Inventor: Douglas Tatlow, Vernon (CA)

( * ) Notice: Subject to any disclaimer, the term of this patent is extended or adjusted under 35 U.S.C. 154(b) by 1221 days.

(21) Appl. No.: 12/448,137

(22) PCT Filed: Dec. 21, 2006

(86) PCT No.: PCT/CA2006/002079

§ 371 (c)(1),
(2), (4) Date: Jun. 10, 2009

(87) PCT Pub. No.: WO2008/074121

PCT Pub. Date: Jun. 26, 2008

(65) Prior Publication Data

US 2010/0024800 A1 Feb. 4, 2010

(51) Int. Cl.
*F24C 3/08* (2006.01)
*F24C 3/14* (2006.01)

(52) U.S. Cl.
CPC .. *F24C 3/14* (2013.01); *F24C 3/085* (2013.01)

(58) Field of Classification Search
CPC ..... F24C 3/085; F24C 3/14
USPC ..... 126/39 E, 39 C, 15 R, 25 R
See application file for complete search history.

(56) References Cited

U.S. PATENT DOCUMENTS

| | | | | |
|---|---|---|---|---|
| 2,515,521 | A * | 7/1950 | Loffredo | 126/9 B |
| 3,386,432 | A * | 6/1968 | Hauson | 126/41 R |
| 3,791,368 | A * | 2/1974 | Hunt | 126/25 A |
| 3,978,844 | A * | 9/1976 | Wilkens | 126/38 |
| 4,094,295 | A * | 6/1978 | Boswell et al. | 126/25 R |
| 4,328,783 | A * | 5/1982 | Martenson | 126/25 R |
| 5,285,770 | A * | 2/1994 | Kim | 126/25 B |
| 5,286,770 | A * | 2/1994 | Bastioli et al. | 524/52 |
| 6,276,356 | B1 * | 8/2001 | Ragland et al. | 126/41 R |

* cited by examiner

*Primary Examiner* — Avinash Savani
*Assistant Examiner* — Aaron Heyamoto
(74) *Attorney, Agent, or Firm* — George A. Seaby

(57) ABSTRACT

A portable self-contained fuel-fired cooking appliance (10) for heating food stuffs that does not have an exposed flame and is useable in all weather conditions The cooking appliance includes a base (12) with peripheral side walls (18), a handle (46), legs (58) and an open top (26), a heat source (32) positioned in the base (12), a cooking pan (30) removably received in the base, a lid (31) received on the pan and a gas supplying container (50) The base (12) also includes at least one air inlet passage (34), one air exit passage (36) and air baffles (40).

19 Claims, 9 Drawing Sheets

PORTABLE FUEL-FIRED COOKING APPLIANCE

The present invention relates generally to portable cooking appliances. More particularly, relating to a portable, self-contained fuel-fired cooking appliance for cooking any kind of foodstuff.

A number of portable fuel-fired cooking appliances for heating foodstuffs have been devised. Most of them, however, have an exposed flame that can present a safety hazard and that are subjected to weather, and therefore can be used only under limited conditions. For example when the flame would not be extinguished from wind, rain or snow or when an exposed flame does not be a hazard. Other known types of portable fuel-fired cooking appliances are relatively bulky, and therefore inconvenient to carry.

An object of the present invention is therefore to remedy the deficiencies and inconveniences of the known portable, fuel-fired cooking appliances by providing an improved portable, fuel-fired cooking appliance that can be used under all weather conditions, does not have an exposed flame, is not bulky and therefore easy to transport and operate, and which is simple in construction making the portable.

In general, in one aspect, cooking appliance is provided that includes a base having a bottom, peripheral sidewall extending upwardly from the bottom, and an open top extending into an open interior space defined by the bottom and the sidewall. A cooking pan is removably received by the base through the open top such that a bottom surface of the cooking pan is disposed a distance above the bottom of the base. A heat source is positionable within the interior space and approximate the bottom surface of the cooking pan. The base defining at least one first air-inlet passage through the bottom thereof at a position outwardly of the heat source. The base defining at least one air-exit passage through the sidewall thereof at a position below the bottom surface of the cooking pan.

In general, in another aspect a portable cooking appliance is provided that includes a base of generally rectangular shape. The base having a bottom, a first and second pair of opposed sidewalls extending upwardly from the bottom, and an open top extending into an open interior space defined by the bottom and the first and second pair of opposed sidewalls. A cooking pan removably received by the base through the open top such that a bottom surface of the cooking pan is disposed a distance above the bottom of the base. A fuel-fired burner centrally positioned within the interior space and approximate the bottom surface of the cooking pan. The bottom of the base defining a plurality of spaced air-inlet openings therethrough at a position outwardly of the fuel-fired burner. One sidewall of the first pair of opposed sidewalls defining at least one air-exit passage therethrough at a position below the bottom surface of the cooking pan. A support means for supporting the base above a support surface.

In general, in another aspect a portable cooking appliance is provided that includes a base of generally rectangular shape. The base having a bottom, a first and second pair of opposed sidewalls extending upwardly from the bottom, and an open top extending into an open interior space defined by the bottom and the first and second pair of opposed sidewalls. A cooking pan removably received by the base through the open top such that a bottom surface of the cooking pan is disposed a distance above the bottom of the base. The bottom of the base defining a centrally disposed fuel receiving recess having a peripheral sidewall depending downwardly from the bottom and terminating at a support surface. The bottom of the base defining a plurality of spaced air-inlet openings therethrough at a position outwardly of the fuel receiving recess. One sidewall of the first pair of opposed sidewalls defining at least one air-exit passage therethrough at a position below the bottom surface of the cooking pan. A support means for supporting the base above a support surface.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

The invention will be better understood and objects other than those set forth above will become apparent when consideration is given to the following detailed description thereof. Such description makes reference to the annexed drawings wherein.

Figure 1:
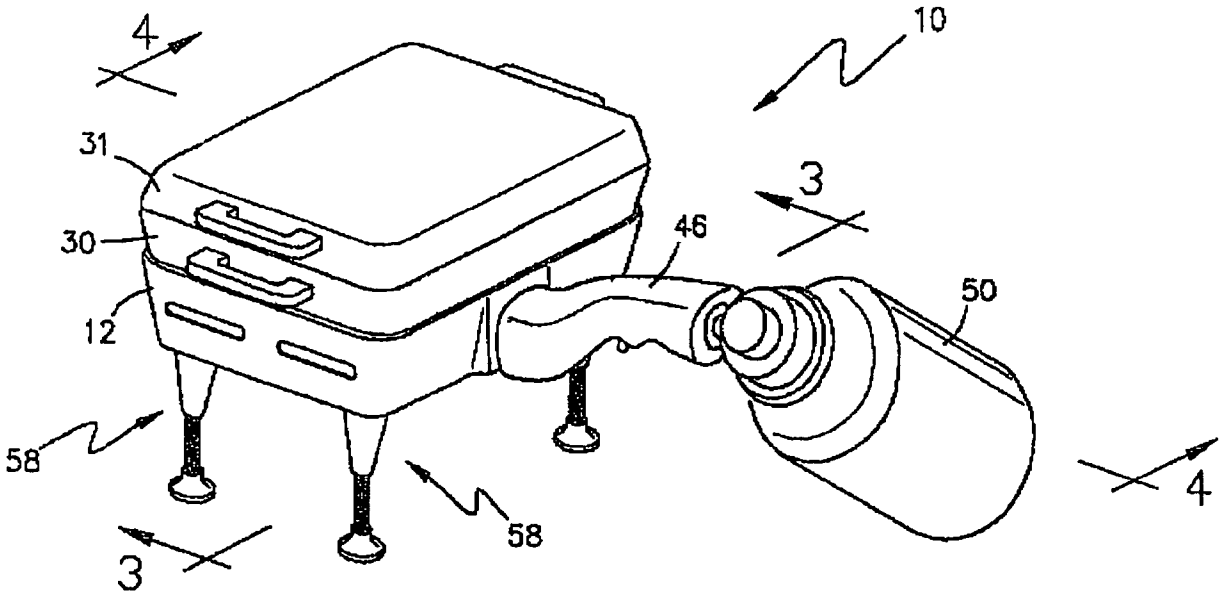
FIG. 1 is a diagrammatic perspective view of a first embodiment of the portable, self-contained fuel-fired cooking appliance constructed in accordance with the principles of the present invention.
Figure 2:
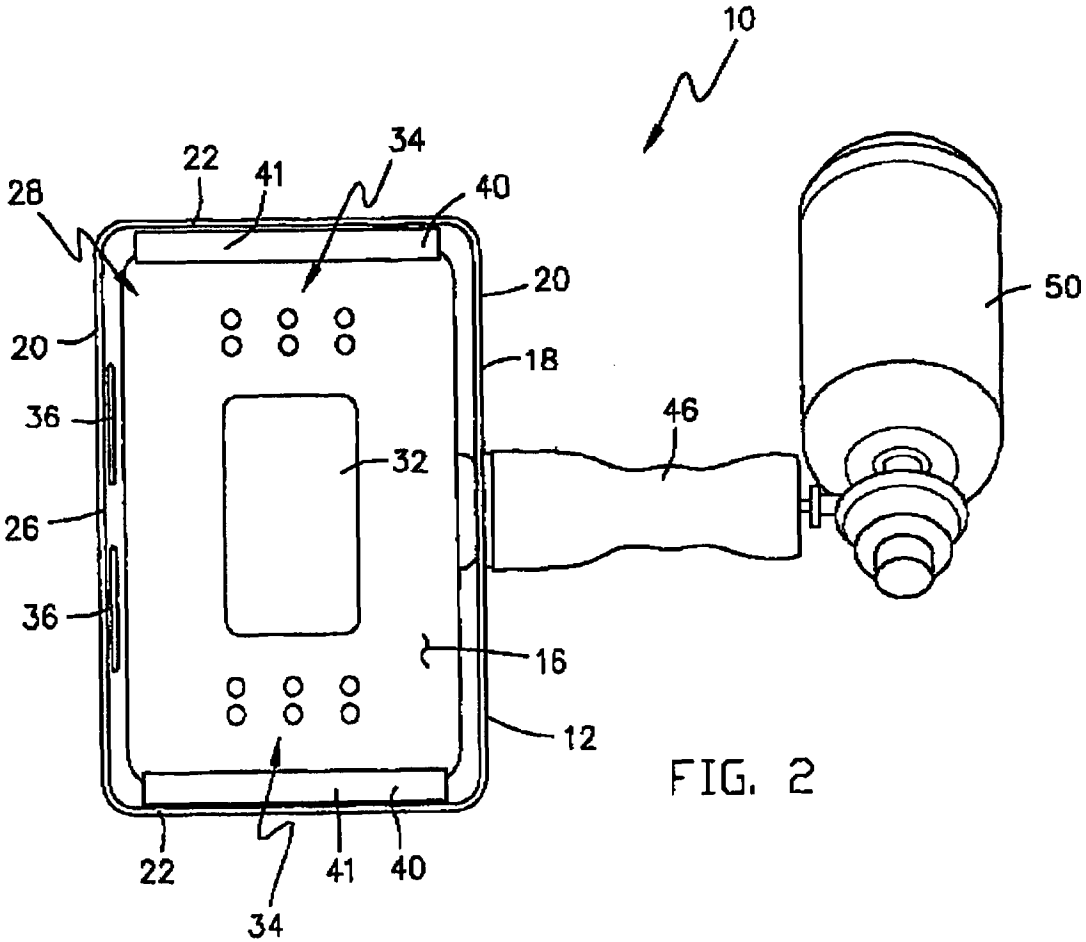
FIG. 2 is a diagrammatic top view of the base of the first embodiment shown in FIG. 1.

The portable, self-contained fuel-fired cooking appliance illustrated in the accompanying drawings is particularly useful for heating foodstuffs and cooking under all weather conditions or when an exposed flame may present a hazard.

With reference to FIGS. 1-4, there is shown a cooking appliance 10 comprising a base 12, a cooking container 30, and a lid 31 for selectively covering the cooking container.

The base 12 includes a bottom 16 and a peripheral sidewall 18 extending upwardly therefrom. In the exemplary embodiment shown, the base 12 is generally rectangular and the sidewall 18 comprises opposed sidewalls 20 and opposed end walls 22. The top end 26 of the base 10 comprises an open top end 26 above a compartment 28 adapted to accommodate the container 30, such as a rectangular cooking pan. The container 30 is removably insertable into the compartment 28 through the open top end 26 and supported therein such that the bottom of the container is disposed above the bottom 16. A pair of handles are attached to opposed walls of the container to facilitate the lifting and inserting of the container into and out of the compartment 28. The lid 31 also includes a pair of handles attached to opposed walls of the lid to facilitate the covering of the container.

A gas burner 32 is centrally disposed within the compartment 28 below the container 30 and is operated to heat the container, thereby heating or cooking of any foodstuff. Combustion supporting air inlets 34 are formed through the bottom 16 along at least one side of the gas burner 32. The air inlets 34 permit atmospheric air to enter the compartment 28 to support the combustion of a gas by the gas burner 32. The air inlets 34 may be formed through the bottom 16 along opposed sides of the gas burner 32.

Air exit openings 36 are formed through one sidewall 20 of the first pair of opposed sidewalls 20 at a position below the container 30. The air exit openings 36 allow combustion gases within the compartment 28 to escape towards the outside atmosphere. The air exit openings 36 are formed through the sidewall 20 opposite the side a user would typically be in order to prevent injury to the user from the hot combustion gases flowing outward from the air exit openings 36.

Figure 3:
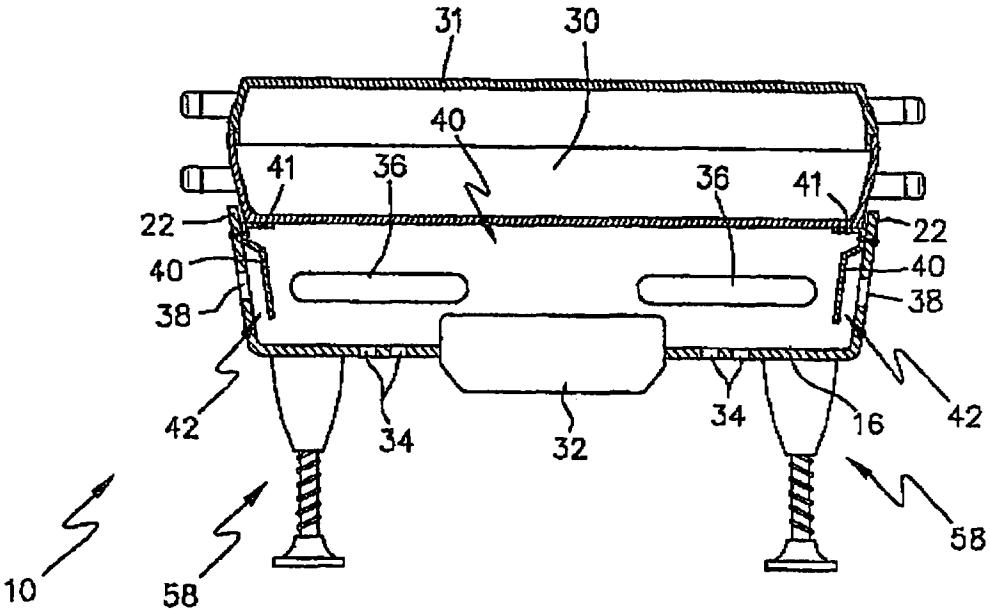
FIG. 3 is a cross sectional view taken along line 3-3 in FIG. 2.

With particular reference to FIG. 3, secondary combustion supporting air inlets 38 are formed through at least one end wall 22 at a position below the container 30. Ideally, the secondary combustion air inlets 38 are formed through both end walls 22. A baffle 40 is mounted on the interior of each end wall 22. The baffle 40 is defined by a strip of material attached at an upper end thereof to the respective end wall 22. The strip extends inwardly and downwardly in the compartment 28 to a location above and spaced apart from the bottom 16 of the housing 12. Thus, the baffle 40 forms a channel 42 with the end wall through which atmospheric air entering the secondary combustion supporting inlets 38 is directed downwardly to a location below the air exit openings 36 and above or about level with the top of the gas burner 32. The baffles 40 while shown as being separate from the housing 12 can be formed integrally therewith. The channeling of atmospheric air through channels 42 permits delivery of combustion supporting air to the gas burner 32, which otherwise would have to flow against the upward convection current of the hot combustion gas flowing out of the air exit openings 36. Further, the channeling of the atmospheric air through channels 42 prevents the gas burner from being extinguished by a gust of wind.

The top ends 40 of the baffles 40 extend inwardly towards each other defining a shoulder or lip 41 for supporting the container 30 thereon as shown in FIG. 3.

Figure 4:
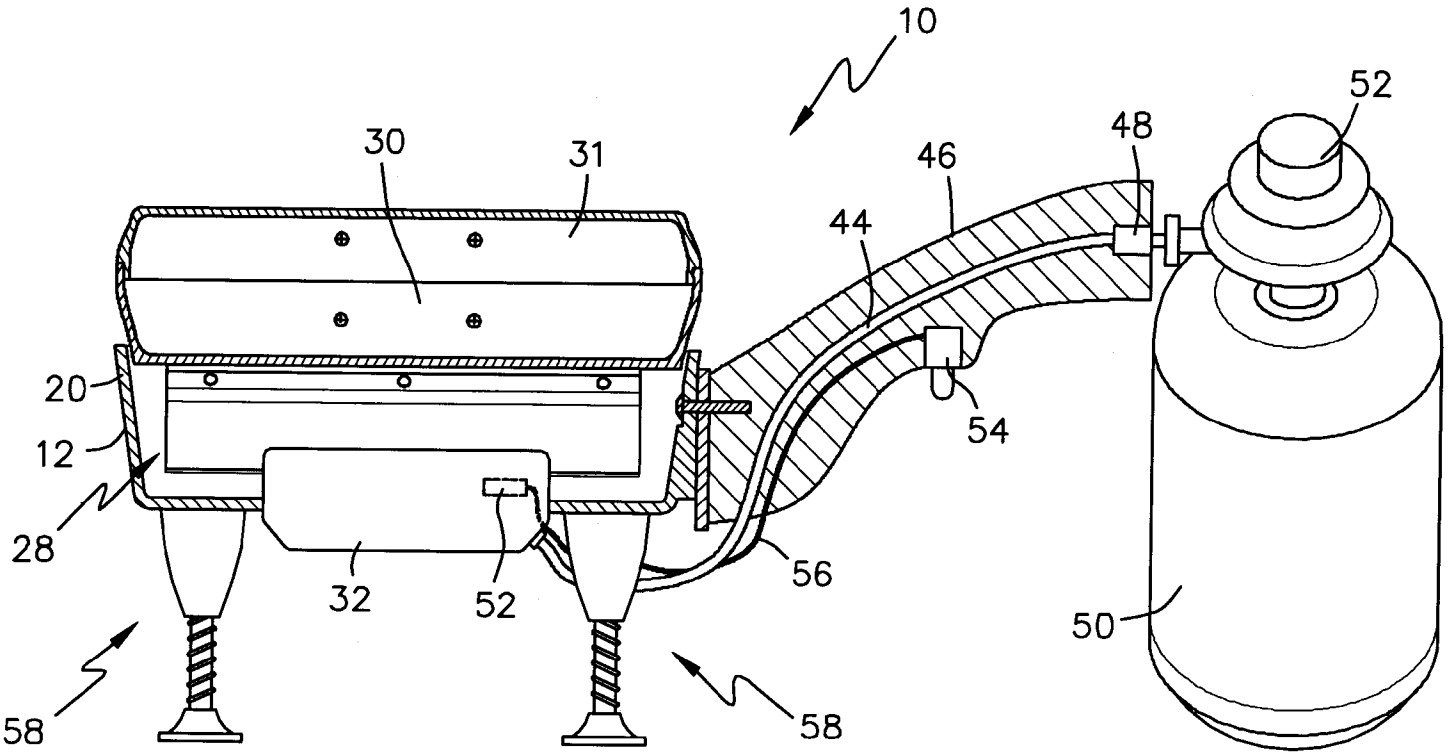
FIG. 4 is a cross sectional view taken along line 4-4 in FIG. 1.
Figure 5:
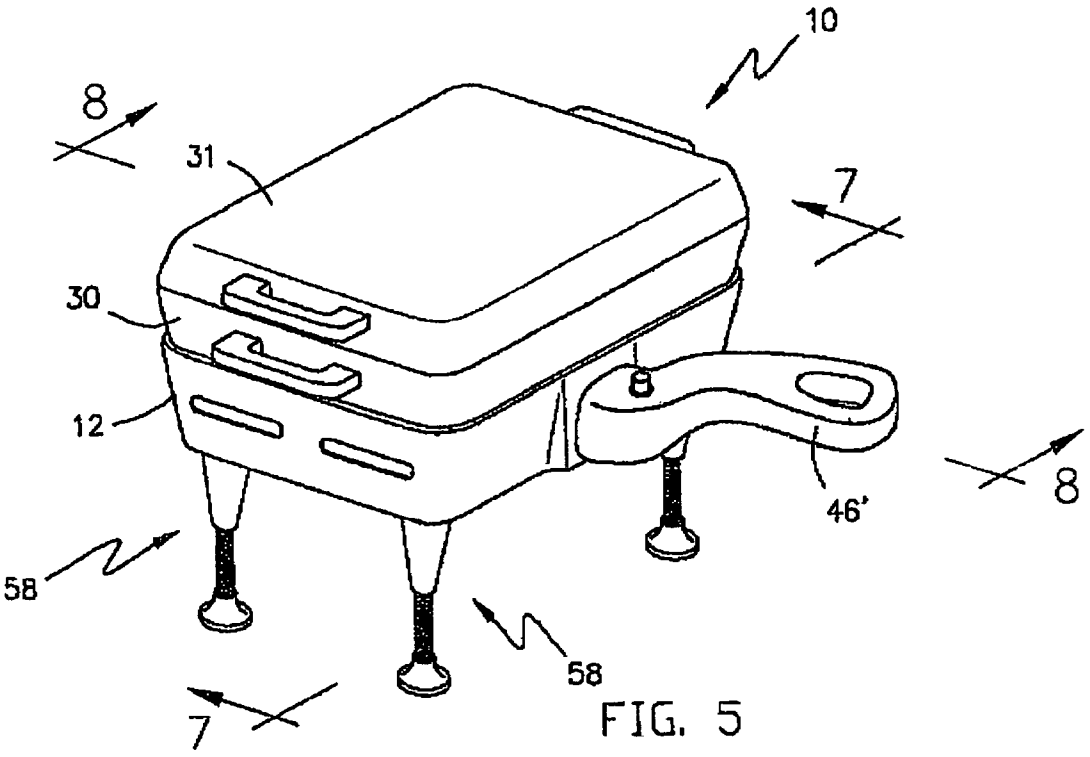
FIG. 5 is a diagrammatic perspective view of a second embodiment of the portable, self-contained fuel-fired cooking appliance constructed in accordance with the principles of the present invention.

With reference to FIG. 4, extending from the sidewall 20 opposite the sidewall through which the air exit openings 36 are formed is a handle 46 made of a heat insulating material. A gas supply line 44 extends through the handle 46 from a distal end thereof to the gas burner 32. A fitting 48 disposed at the distal end of the handle 42 permits the connection of a gas-supplying container 50 of a pressurized gas, such as propane, to the gas supply line 44 for feeding gas under pressure to the gas burner 32. A control valve 52 is disposed between the fitting 48 and the gas-supplying container 50 for controlling the delivery of gas to the gas burner 32. The gas-supplying container 50 is normally sealed during filling, which seal must be broken when the container is first to be used. For this purpose, the fitting 48 may include a pointed projection (not shown) to facilitate the piercing of the seal fitted to the gas-supplying container 50 during connection the gas supply container to the fitting.

A piezoelectric or magneto igniter 52 of the type well known in the art is positioned approximate the gas burner 32 and is operated to ignite the gas burner 32. The igniter 52 includes an ignition button 54 of the type normally used with a piezoelectric or magneto ignition device that can be positioned on the underside of the handle 42. The positioning of the ignition button 54 permits a person using one hand to steady the cooking appliance 10 and simultaneously operate the ignition button 54. The igniter 52 and the ignition button 54 are electrically connected by wire 56.

The cooking appliance 10 further includes a support leg 58 attached at each corner of the bottom 16 of the housing 12. Each leg 58 is height adjustable and includes a support base 60 that is attached to the bottom 16, an extensible leg portion 62 having one end that is threadable into and out of the support base to permit adjusting the length of the leg 58, and a foot pad 65 attached to the opposite end of the leg portion.

According to another embodiment as shown in FIGS. 5-8, a solid fuel source is used opposed to a gas fuel source. As such, the elements required to support the combustion of the gas fuel are not included. However, the basic construction of the cooking appliance 10 remains the same and the same reference numerals will be used for the common elements.

As in the previous embodiment, the cooking appliance 10 comprising a base 12, a cooking container 30, and a lid 31 for selectively covering the cooking container. The base 12 includes a bottom 16 and a peripheral sidewall 18 extending upwardly therefrom. In the exemplary embodiment shown, the base 12 is generally rectangular and the sidewall 18 comprises opposed sidewalls 20 and opposed end walls 22. The top end 26 of the base 10 is open above a compartment 28 adapted to accommodate the container 30, such as a rectangular cooking pan. The container 30 is removably insertable into the compartment 28 through the open top end 26 and supported therein such that the bottom of the container is disposed above the bottom 16. A pair of handles are attached to opposed walls of the container to facilitate the lifting and inserting of the container into and out of the compartment 28. The lid 31 also includes a pair of handles attached to opposed walls of the lid to facilitate the covering of the container.

Figure 6:
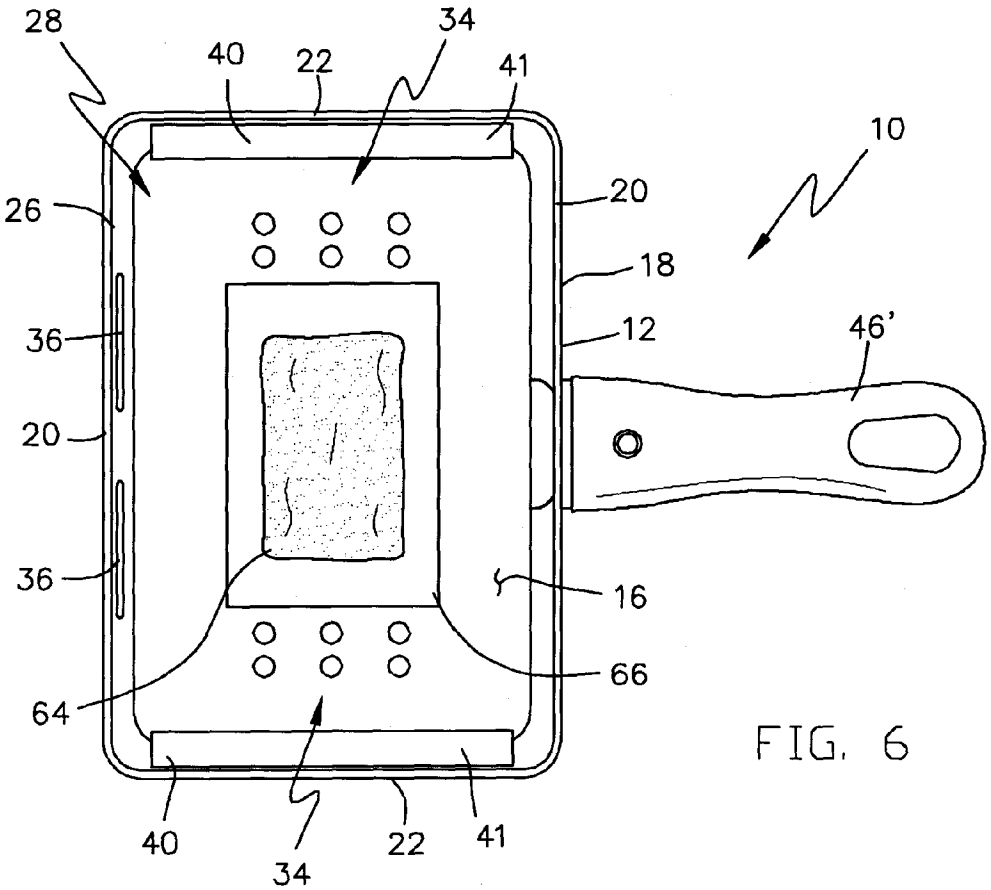
FIG. 6 is a diagrammatic top view of the base of the second embodiment shown in FIG. 5.
Figure 7:
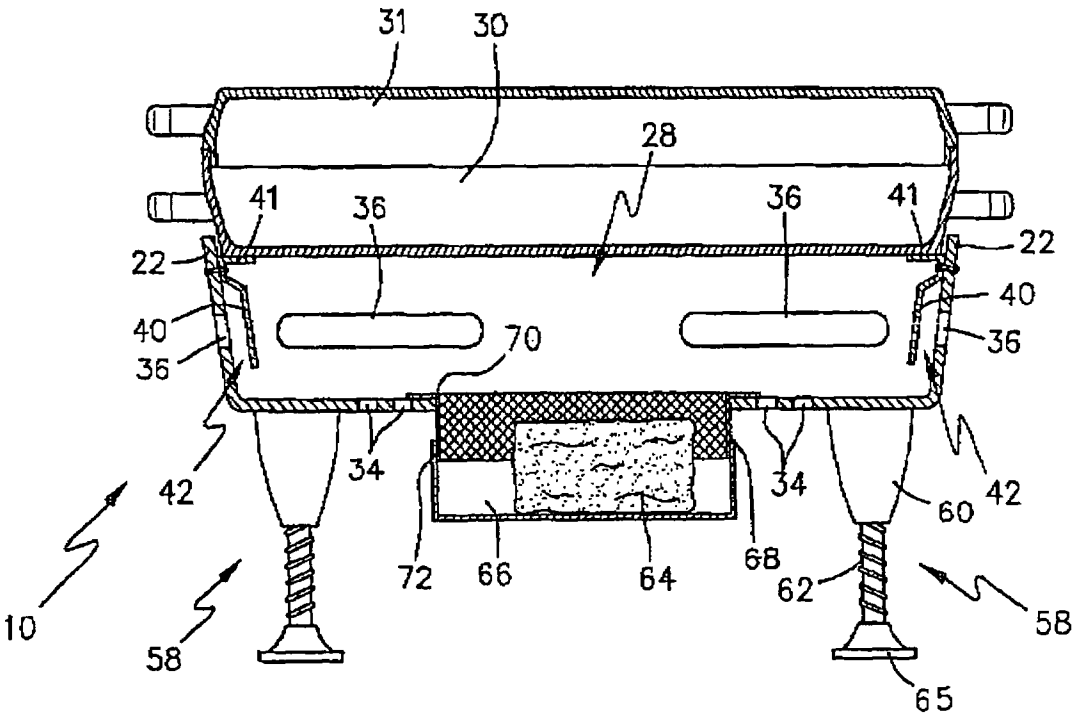
FIG. 7 is a cross sectional view taken along line 7-7 in FIG. 6.
Figure 8:
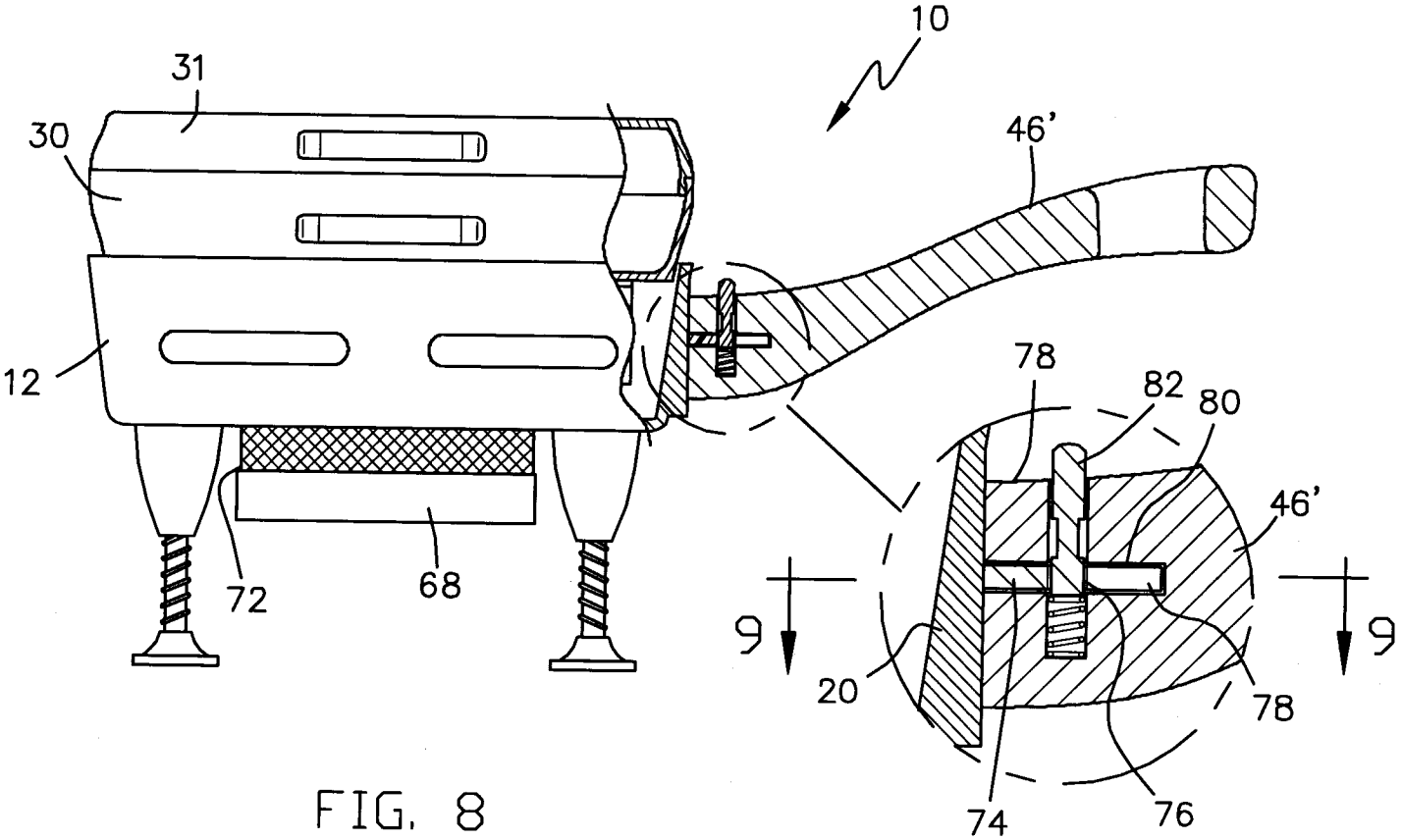
FIG. 8 is a cross sectional view taken along line 8-8 in FIG. 7.

In this embodiment, as best seen in FIGS. 6-8, instead of using a gas fuel source and a burner to combust the gas, a solid fuel element 64 is used. To accommodate the solid fuel 64 a recess 66 is centrally disposed through the bottom 16 of the housing 12. The recess 66 can be formed as one with the bottom 16 or can comprise a tray 68 of a material such as metal or any other material that is not readily combustible. The tray 68 is attached to the bottom about a central opening 70 formed through the bottom. In either case, the sidewall 72 of the recess 66 or tray 68 is perforated to permit the ingress of combustion supporting air to the solid fuel 64. Ideally, only the upper half or portion of the sidewall 72 is perforated and the bottom is free of openings to contain the solid fuel 64 within the recess or tray.

Air exit openings 36 are formed through one sidewall 20 of the first pair of opposed sidewalls 20 at a position below the container 30. The air exit openings 36 allow combustion gases within the compartment 28 to escape to the outside atmosphere. The air exit openings 36 are formed through the sidewall 20 opposite the side a user would typically be in order to prevent injury to the user from the hot combustion gases flowing outward from the air exit openings 36.

Combustion supporting air inlets 34 are formed through the bottom 16 along at least one side of the recess 66 or tray 68. The air inlets 34 permit atmospheric air to enter the compartment 28 to support the combustion of the solid fuel 64. The air inlets 34 may be formed through the bottom 16 along opposed sides of the recess 66 or tray 68.

With particular reference to FIG. 7, secondary combustion supporting air inlets 38 are formed through at least one end wall 22 at a position below the container 30. Ideally, the secondary combustion air inlets 38 are formed through both end walls 22. A pair of baffles 40 are disposed within the compartment 28 at a position inwardly of each end wall 22. Each baffle 40 is attached at an upper end thereof to the respective end wall 22 and forms a channel 42 therewith through which atmospheric air entering the secondary combustion supporting inlets 38 is directed downwardly to an elevation that is below the air exit openings 36 and above or about level with the top of the solid fuel 64. The baffles 40 while shown as being separate of the housing 12 can be formed integrally therewith. The channeling of atmospheric air through channels 42 permits delivery of combustion supporting air to the solid fuel 64, which otherwise would have to flow against the upward convection current of the hot combustion gas flowing outward of the air exit openings 36. Further, the channeling of the atmospheric air through channels 42 prevents the solid fuel 64 from being extinguished by a gust of wind. Further, a shoulder or lip 41 extends from the upper end of each baffle 40 inwardly into the compartment 28 for supporting the container 30 thereon as shown in FIG. 3.

Figure 9:
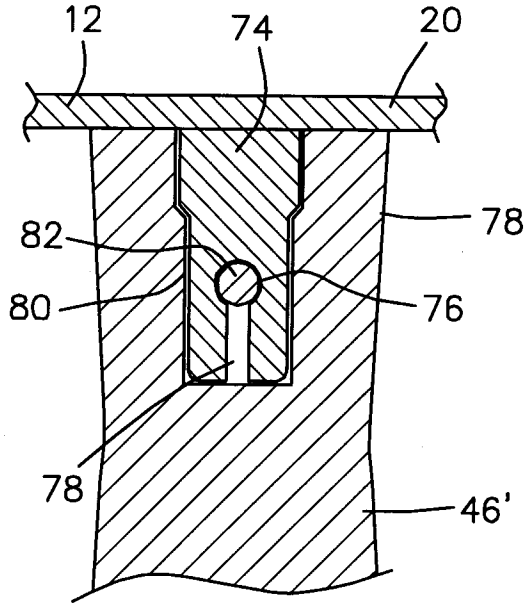
FIG. 9 is a cross sectional view taken along line 9-9 in FIG. 8.

With particular reference to FIGS. 8 and 9, this embodiment differs further in that the handle 46' is removably attached to the sidewall 20 of the base 12. In one example, a support plate 74 extends outwardly from the sidewall 20 and includes a through hole 76 formed therethrough. A slot 78 extends from the forward end of the plate 74 and intersects with the through hole 76. The width of the slot 78 is less than the diameter of the through hole 76. The handle end 78 includes a horizontal slot 80 into which the support plate 74 is removably received. A vertical pin 82 intersect the slot 80 and is held slidably captive by the handle end 78 such that the pin can translate vertically in both directions. The upper portion of the pin 82 has a diameter equal to the width of slot 78 and the lower portion of the pin has a diameter equal to the through hole 76. The pin 82 is spring biased upwardly such that the lower portion of the pin 82 intersects the slot 80. The upper portion the pin 82 extends beyond the handle 46' a distance such that pressing down on the pin causes the pin to move downwardly intersecting the upper portion of the pin with the slot 80.

In operation, the handle 42' is attached to the base 12 by pressing down on the pin 82 so as to intersect the upper portion of the pin with slot 80. In this position, the upper portion of the pin 82 having a diameter equal to the slot 78 permits the plate 74 to be inserted into slot 80 by passing pin along slot 78 until the pin reaches the through hole 76. Once the pin 82 is aligned with the through hole 76, the pin is released and is spring biased upwardly aligning the lower portion of the pin with the through hole. The lower portion of the pin 82 having a diameter equal to the through hole 76 prevents the pin 82 from being cable of passing along slot 78, thereby locking the handle 42' to the plate 74.

A number of embodiments of the present invention have been described. Nevertheless, it will be understood that various modifications may be made without departing from the spirit and scope of the invention. Accordingly, other embodiments are within the scope of the following claims.

I claim:

1. A portable cooking appliance comprising:

a rectangular base having a bottom, a pair of opposed sidewalls and a pair of opposed end walls extending upwardly from said bottom, and an open top above an interior space defined by said bottom, said pair of opposed sidewalls and said pair of opposed end walls;

a cooking pan removably received by said base through said open top such that a bottom surface of said cooking pan is disposed a distance above said bottom of said base;

a central opening in said bottom of said base;

a fuel-fired burner in said interior space proximate said bottom surface of said cooking pan;

a plurality of spaced apart air-inlet openings in said bottom of said base located outwardly of said fuel-fired burner;

at least one air-exit passage in one sidewall at a location below said bottom surface of said cooking pan;

support means for supporting said base above a support surface;

at least one second air-inlet passage in one end wall at a location below said bottom surface of said cooking pan; and a first air directing baffle including a strip of material having an upper end attached to said end wall above said at least one second air inlet passage, the strip extending inwardly and downwardly from said end wall to a location above and spaced apart from the bottom of said base for channeling air downwardly to a location below the at least one air exit passage and above the base, the strip having a bottom end parallel to and spaced apart from said end wall for preventing the burner being extinguished by a gust of wind.

2. The portable cooking appliance of claim 1, further comprising:

a handle attached to; one of said first pair of opposed sidewalls;

a fuel line in said handle extending from an outer end of said handle to said fuel-fired burner;

a supply of fuel releasably attachable to said fuel line at said outer end of said handle; and control means for controlling the delivery of fuel from said supply of fuel to said fuel-fired burner.

3. The portable cooking appliance of claim 2, further comprising:

an electric ignition device for igniting said fuel-fired burner.

4. A portable cooking appliance comprising:

a rectangular base having a bottom, a pair of opposed sidewalls extending upwardly from said bottom, a pair of opposed end walls extending upwardly from said bottom and an open top above an interior space defined by said bottom, said pair of opposed sidewalls and said pair of opposed end walls;

a cooking pan removably received by said base through said open top such that a bottom surface of said cooking pan is disposed a distance above said bottom of said base;

a fuel receiving recess in the center of the bottom of the base, said recess having a peripheral sidewall depending downwardly from said bottom and terminating at a support surface;

a plurality of spaced air-inlet openings in the bottom of the base at locations outwardly of said fuel receiving recess;

at least one air-exit passage in one sidewall at a location below said bottom surface of said cooking pan;

a support means for supporting said base above a support surface;

at least one second air-inlet passage in each end wall of said base below said bottom surface of said cooking pan;

first and second air directing baffles, each of said first and second baffles including a strip of material having an upper end attached to said end wall above said at least one second air inlet passage, the strip extending inwardly and downwardly from said end wall to a location above and spaced apart from the bottom of said base for channeling air downwardly to a location below the at least one air exit passage and above the base, the strip having a bottom end parallel to and spaced apart from said end wall for preventing the burner being extinguished by a gust of wind.

5. The portable cooking appliance of claim 4 including a plurality of apertures in said peripheral sidewall of said fuel receiving recess.

6. A cooking appliance comprising:

a one-piece base having a bottom, a peripheral sidewall extending upwardly from said bottom, and an open top above an interior space defined by said bottom and said sidewall;

a cooking pan removably received by said base through said open top such that a bottom surface of said cooking pan is disposed a distance above said bottom of said base;

a central opening in said bottom of the base;

a heat source positionable in said central opening proximate said bottom surface of said cooking pan;

at least one first air-inlet passage in the bottom of said base at a position spaced apart from said heat source;

at least one air-exit passage in the sidewall of said base at a location below said bottom surface of said cooking pan;

at least one second air-inlet passage in the sidewall of said base at a location below said bottom surface of said cooking pan; and an air directing baffle including a strip of material having an upper end attached to said sidewall above said at least one second air-inlet passage, the strip extending inwardly and downwardly from the sidewall to a location above and spaced apart from the bottom of said base for channeling air downwardly to a location below the at least one air-exit passage and above the base, the strip having a bottom end parallel to and spaced apart from said end wall for preventing the burner being extinguished by a gust of wind.

7. The cooking appliance of claim 6, wherein:

said heat source is a fuel-fired burner.

8. The cooking appliance of claim 7, wherein said fuel-fired burner is located within said interior space and extends upwardly through said central opening in said bottom of said base.

9. The cooking appliance of claim 8, wherein at least one first air-inlet passage comprises a plurality of holes space apart from said central opening in said base.

10. The cooking appliance of claim 7 further comprising:

a source of fuel connected to said burner; and control means for controlling the quantity of fuel delivered from said source of fuel to said fuel-fired burner.

11. The cooking appliance of claim 10, further comprising:

a handle attached to and extending outwardly from said base; and wherein said source of fuel is removably attachable to a fuel supply line extending through said handle to said fuel-fired burner.

12. The cooking appliance of claim 6 including:

a plurality of legs attached to and extending downwardly from said base.

13. The cooking appliance of claim 12, wherein each of said plurality of legs is height adjustable.

14. The cooking appliance of claim 6, wherein said heat source is a combustible solid fuel.

15. The cooking appliance of claim 14 including a central recess in said bottom of said base for removably receiving said combustible solid fuel.

16. The cooking appliance of claim 15 including a plurality of apertures in a sidewall of said centrally disposed recess.

17. The cooking appliance of claim 1, wherein said first air directing baffle includes a shoulder for supporting the cooking pan in a top end of said base above said air-inlet and air-exit passages.

18. The cooking appliance of claim 4, wherein said first and second air directing baffles include shoulders for supporting the cooking pan in a top end of said base above said air-inlet and air-exit passages.

19. The cooking appliance of claim 6, wherein said air directing baffle includes a shoulder for supporting the cooking pan in a top end of said base above said air-inlet and air-exit passages.

* * * * *